US007370397B2

(12) United States Patent
Staquet

(10) Patent No.: US 7,370,397 B2
(45) **Date of Patent: *May 13, 2008**

(54) TOOL KIT AND METHOD FOR REPAIRING A DAMAGE VEHICLE BODY MEMBER WITH A HEM FLANGE

(75) Inventor: Edward T. Staquet, Broomall, PA (US)

(73) Assignee: Lord Corporation, Cary, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/496,840

(22) Filed: Aug. 1, 2006

(65) Prior Publication Data

US 2006/0277736 A1 Dec. 14, 2006

Related U.S. Application Data

(63) Continuation of application No. 10/639,223, filed on Aug. 11, 2003, now Pat. No. 7,107,660, which is a continuation-in-part of application No. 10/201,231, filed on Jul. 23, 2002, now Pat. No. 6,609,406, which is a continuation-in-part of application No. 10/200,670, filed on Jul. 22, 2002, now Pat. No. 6,898,958, which is a continuation of application No. 09/905,288, filed on Jul. 13, 2001, now Pat. No. 6,439,024.

(51) Int. Cl.
*B23P 6/00* (2006.01)
*B21J 13/02* (2006.01)

(52) U.S. Cl. ..... 29/402.03; 29/402.08; 29/402.11; 72/479

(58) Field of Classification Search ..... 29/402.01, 29/402.03, 402.08, 402.09, 402.02, 402.11, 29/402.12, 402.18, 426.4, 426.5, 275, 243.57, 29/243.58; 72/479, 176, 458, 459
See application file for complete search history.

(56) References Cited

U.S. PATENT DOCUMENTS

| | | | | | |
|---|---|---|---|---|---|
| 421,187 | A * | 2/1890 | Myers | 81/300 |
| 2,143,339 | A * | 1/1939 | Wiese | 81/342 |
| 2,547,391 | A * | 4/1951 | Hauschild | 7/158 |
| 2,637,292 | A * | 5/1953 | George, Jr. | 29/34 R |
| 2,810,420 | A * | 10/1957 | Gibson | 72/479 |
| 2,938,413 | A * | 5/1960 | Pauls | 72/479 |
| 3,123,124 | A * | 3/1964 | Armitage | 72/321 |
| 3,166,961 | A * | 1/1965 | Chaplin, Sr. | 72/406 |
| 3,180,128 | A * | 4/1965 | Faulkner | 72/409.08 |
| 3,213,817 | A * | 10/1965 | Werner | 29/243.57 |
| 3,421,356 | A * | 1/1969 | Buske | 72/387 |

(Continued)

*Primary Examiner*—Essama Omgba
(74) *Attorney, Agent, or Firm*—Edward F. Murphy, III

(57) ABSTRACT

A method and kit for repairing vehicle door skins by reorienting vehicle hem flanges from a closed orientation to an open orientation to allow removal of a damaged door skin from a door frame and replacing with a new door skin with an open orientation hem flange that is reoriented to a closed orientation to integrate the door skin and door frame with an adhesive. The repair kit includes a first tool for lifting and opening the damaged door skin hem flange to allow removal of the damaged door skin and reuse of the door frame. The tool kit includes a second repair tool for reorientation and closing the new door skin replacement door skin hem flange on the reused door frame with an adhesive to provide a repaired vehicle door with the replacement skin and reused door frame integral as a vehicle door.

3 Claims, 11 Drawing Sheets

U.S. PATENT DOCUMENTS 3,426,573 A * 2/1969 Wilson, Jr. ..... 72/434
3,477,272 A * 11/1969 Hunter ..... 72/445
3,541,836 A * 11/1970 Meis ..... 72/479
3,602,032 A * 8/1971 Skintzis ..... 72/445
3,777,687 A * 12/1973 Colman, Jr. ..... 29/243.58
3,877,286 A * 4/1975 Fontaine et al. ..... 72/450
3,961,518 A * 6/1976 Osbolt ..... 72/409.13
3,987,740 A * 10/1976 Merson ..... 29/243.58
4,034,595 A * 7/1977 Smith ..... 72/458
4,060,046 A * 11/1977 Eckold et al. ..... 29/243.58
4,120,256 A * 10/1978 Semler ..... 72/429
4,145,907 A * 3/1979 Barber et al. ..... 72/318
4,148,205 A * 4/1979 Boysen ..... 72/176
4,176,541 A * 12/1979 Cooper ..... 72/474
4,318,211 A * 3/1982 Hoskinson ..... 29/243.5
4,372,022 A * 2/1983 Puckett ..... 29/243.58
4,475,373 A * 10/1984 Ikenberry ..... 72/392
4,517,724 A * 5/1985 Gee ..... 29/275
4,713,959 A * 12/1987 Bennett ..... 72/409.18
4,825,676 A * 5/1989 Diggins ..... 72/211
4,827,595 A * 5/1989 Dacey, Jr. ..... 29/432.2
4,926,536 A * 5/1990 Kohut ..... 29/238
4,974,441 A * 12/1990 Keeney et al. ..... 72/458
5,052,209 A * 10/1991 DeMaagd ..... 72/458
5,090,101 A * 2/1992 Welty ..... 29/243.5
5,095,732 A * 3/1992 Bootka ..... 72/409.18
5,119,667 A * 6/1992 Hollis et al. ..... 72/453.16
5,394,729 A * 3/1995 Eisenhower, Jr. ..... 72/450
5,457,981 A * 10/1995 Brown et al. ..... 72/451
5,461,900 A * 10/1995 Gutierrez ..... 72/479
5,611,237 A * 3/1997 Harper ..... 72/458
5,634,251 A * 6/1997 Kraft ..... 29/243.5
5,730,021 A * 3/1998 Johnson ..... 72/453.01
5,875,670 A * 3/1999 Stojkovski et al. ..... 72/211
5,878,617 A * 3/1999 Parker ..... 72/409.12
5,940,950 A * 8/1999 Galat ..... 29/235
6,038,753 A * 3/2000 Willett ..... 29/235
6,089,075 A * 7/2000 Bramblett ..... 72/458
6,131,434 A * 10/2000 Schneider, Jr. ..... 72/479
6,161,410 A * 12/2000 Shook et al. ..... 72/220
6,257,043 B1 * 7/2001 Wiens ..... 72/412
6,439,024 B1 * 8/2002 Staquet ..... 72/458
6,470,729 B1 * 10/2002 Hughes et al. ..... 72/479
6,578,404 B1 * 6/2003 Rousseau ..... 72/413
6,609,406 B1 * 8/2003 Staquet ..... 72/479
6,898,958 B2 * 5/2005 Staquet ..... 72/458
7,017,385 B2 * 3/2006 Trueit et al. ..... 72/479
7,107,660 B2 * 9/2006 Staquet ..... 29/402.08
2001/0029766 A1 * 10/2001 Wiens ..... 72/312
2002/0121125 A1 * 9/2002 Palleschi et al. ..... 72/479

* cited by examiner

TOOL KIT AND METHOD FOR REPAIRING A DAMAGE VEHICLE BODY MEMBER WITH A HEM FLANGE

This application is a Continuation of U.S. patent application Ser. No. 10/639,223 filed Aug. 11, 2003, now U.S. Pat. No. 7,107,660, which is a Continuation-in-Part (CIP) of U.S. patent application Ser. No. 10/201,231, filed Jul. 23, 2002, now U.S. Pat. No. 6,609,406, and is also a Continuation-in-Part (CIP) of U.S. patent application Ser. No. 10/200,670, filed Jul. 22, 2002, now U.S. Pat. No. 6,898,958, which is a Continuation of U.S. patent application Ser. No. 09/905,288, filed Jul. 13, 2001, now U.S. Pat. No. 6,439,024, the priority to which are hereby claimed, and are hereby incorporated by reference.

FIELD OF THE INVENTION

The invention relates to vehicle body repair method of repairing a vehicle body door skin member attached to a vehicle body door frame member. The invention relates to a vehicle body door skin repair tool kit that simplifies opening the hem flange connection between a door skin and a door frame with a hem flange opener tool to allow removal of the damaged door skin and replacement with a new door skin that is attached to the door frame using a hem flange closer tool.

BACKGROUND OF THE INVENTION

A vehicle door such as a door for a car or truck is generally comprised of a door frame and an outer door skin that is made integral with the frame at a hem flange defined by the perimeter edge of the skin. During the door assembly process, a suitable adhesive is placed proximate the peripheral door skin edge. The skin is then placed in the required position on the door frame and the desired hem flange is formed as the perimeter edge of the skin is bent around the frame and down onto the frame to produce the desired hem flange. The adhesive is sandwiched between the hem flange and the frame and forms the desired bond between the hem flange and the door frame. Finally, to ensure the requisite continuous, leakproof and tight bond is developed between the hem flange and door frame, suitable tools such as pliers or a hammer, are used to press, crimp or otherwise force the flange against the frame.

Over time, if the door becomes damaged or develops rust, the door panel skin frequently must be replaced. In order to replace the skin the hem flange is broken using a time consuming process. This prior art process is well known to those skilled in the art. Initially during the skin replacement process a grinding wheel is applied at the flange bend and the flange is ground to a minimum thickness at the bend. During this step in the replacement process, the grinding wheel is moved along the hem flange bend until it is possible to physically separate the main skin portion from the hem. The hem flange is then manually peeled away from the door frame using a chisel. Occasionally it may be necessary to use a hand held tool such as pliers to separate the hem and skin. Finally, the skin is removed from the door frame. It may be necessary to apply an air chisel or another suitable well known manually or pneumatically actuated tool between the skin and frame to break apart the members. Any remaining dried adhesive on the frame is then removed from the frame using a solvent, sandpaper or a suitable tool.

During this prior art removal process, the frame is frequently damaged by the removal tools. Because the new skin is sized to mate with a door frame of precise dimensions, in order to ensure the required bond between the skin and frame is formed, the frame must be reformed and returned to its initial precise dimensions and configuration. Therefore, after removing the hem flange from the door frame and before the new door skin is attached to the frame, it is often necessary for a technician to manually reshape and repair the door frame using a hammer and dolly in order to be able to effectively attach the new skin to the door frame. Repairing and reforming the door frame can be a time consuming and expensive process. Once the frame and skin have been reshaped for effective mating, an adhesive is applied along the periphery of the frame and the hem flange is then bent around the frame to a location proximate the door frame so that the adhesive is sandwiched between the hem flange and door frame. The adhesive forms the desired bond between the flange and frame. The hem flange may be repositioned to a location proximate the door frame using any one or more of known manual repositioning methods such as for example, by striking the flange with a hammer and dolly. Such manual prior art repositioning techniques are time consuming, imprecise and frequently damage the door as the hem flange is struck or gripped and repositioned. Any damage sustained by the door as the joint is formed between the frame and skin must be repaired and as a result undesirably increase the time and cost to repair the door.

The foregoing illustrates limitations known to exist in present tools and methods for repairing vehicle body door hem flanges joining door frames and door skins. Thus, it is apparent that it would be advantageous to provide an alternative directed to overcoming the limitations set forth above. Accordingly, a suitable alternative hem flange removal tool kit and method are provided including features more fully disclosed hereinafter.

SUMMARY OF THE INVENTION

In one aspect of the present invention this is accomplished by providing a tool kit for repairing a vehicle body door skin member by effectively lifting and removing the hem flange without deforming the door frame and reattaching a repair door skin to the door frame. The repair tool kit includes a first tool for lifting and opening the damaged door skin hem flange to allow removal of the damaged door skin and reuse of the door frame. As the hem flange lifting reorienting tool of the present invention is moved along the hem length, the hem flange lifting reorienting tool moves the flange from a first angle of closed orientation, repositions the hem away from the door frame and reorients the hem at an open angle of approximately ninety degrees relative to the door frame. The hem flange lifting reorientation tool of the present invention repositions and reorients the hem flange in one pass along the hem to allow removal of the door skin. In the first step, before the flange is moved from the first closed orientation angle, the tool may also break an adhesive bond between the flange and a frame. By the present invention, the time intensive steps associated with prior art hem flange removal methods including grinding and splitting the hem flange at the bend and reforming the frame are eliminated. The door frame is efficiently reused with a new replacement door skin. The repair tool kit includes a second repair tool for reorientation and closing the new door skin replacement door skin hem flange on the reused door frame with an adhesive to provide a repaired vehicle door with the replacement skin and reused door frame integral as a vehicle door. The invention provides efficient replacement and repair of a damaged vehicle door.

During separation of the skin and frame, a relatively sharp leading edge of the hem flange lifting first tool is driven below the flange and as the first tool is moved along the flange between the flange and frame, the flange is urged away from the frame as the hem rides along a tapered portion of the first tool. When the flange reaches the end of the tapered portion of the first tool, it is located in an orientation gap. The orientation gap is oriented in the direction of travel of the hem flange lifting tool and is defined between a planar longitudinally extending portion of the first tool and an outer rigid skin. When the hem has passed through the gap, the hem is completely separated from the frame and is reoriented at an open angle of orientation. The flange may be separated from the door frame by an open angle of orientation substantially equal to ninety degrees. The significant separation angle allows a technician to easily access the area between the skin and frame to easily remove the door skin from the door frame while avoiding damage to the door frame and allow an efficient replacement of the damaged skin with a replacement skin attached with the second hem flange reorienting tool that makes the new replacement skin integral with the frame with a newly reoriented closed hem flange with the frame interleaved between the skin and reoriented flange.

The hem flange separation first tool and the hem flange reorienting second tool of the present invention may be attached to the end of handles to be manually actuated. Preferrably the hem flange separation tool and the second hem flange tool of the present invention may be attached to a pneumatically actuated tool device such as an air hammer and actuated by the pneumatic tool device.

The invention includes a method of replacement repairing a damaged vehicle door skin with a replacement vehicle door skin. The method includes providing a vehicle door to be repaired with the vehicle door having a reusable door frame and a damaged vehicle door skin attached to said door frame with a hem flange and providing a hem flange repair kit comprised of a first tool hem flange separator and a second tool hem flange reorientor.

The invention includes a method of making a vehicle body hem flange skin repair with a replacement vehicle skin. The method includes providing a vehicle body member to be repaired with the vehicle body member having a reusable frame and a damaged vehicle body skin attached to said frame with a hem flange and providing a vehicle body skin hem flange repair kit comprised of a first tool hem flange separator and a second tool hem flange reorientor.

The invention includes a vehicle body skin hem flange repair kit comprised of a first repair tool and a second repair tool. The first repair tool is comprised of a hem flange separation tool for reorienting and opening a damaged vehicle body skin hem flange from a first angle of orientation to a separated second angle of orientation separated from the vehicle body frame. The second repair tool is comprised of a tapered reorienting surface that progressively urges the repair replacement hem flange towards the vehicle body frame and the repair replacement vehicle body skin to result in an integral vehicle body repair.

The invention includes a vehicle body skin hem flange repair kit comprised of a first repair tool and a second repair tool for efficiently repairing a damaged vehicle door skin with a replacement vehicle door skin. The invention includes replacement repairing a damaged vehicle door skin with a replacement vehicle door skin utilizing the set of the first repair tool and the second repair tool. The invention includes providing a first repair tool comprised of a hem flange separation tool for reorienting the vehicle door hem flange from a first angle of orientation to a second angle of orientation. The hem flange separation tool has a separation tool leading edge adapted to be located between the damaged vehicle door skin flange and the door frame of the door to be repaired. The leading edge has a sharp edge that provides for beneficial and effective insertion between the door skin flange that is to be separated from the door frame that is to be reused with a replacement door skin. The leading edge is driven along the hem flange of the door and provides for separation of the door skin flange from the door frame and piercing of existing cured adhesive layer and breaking of the adhesive layer bond between the flange and the door frame. The leading edge provides for scraping a significant portion of the existing cured adhesive layer off of the door frame for efficient reuse of the door frame with a replacement door skin made integral with the reused door frame using an applied adhesive and the second tool. The hem flange separation tool has a separation tool guide member for maintaining proper orientation of the tool and the leading edge as the leading edge is driven along the length of the hem flange. The hem flange separation tool guide member and the leading edge are maintained in a separation tool orientation by the body of hem flange separation tool in order to insure proper application of the leading edge in the separation of the flange from the door frame. The hem flange separation tool guide member is position relative to the leading edge to provide guidance for the leading edge along the hem flange as hem flange separation tool is driven in the actuation direction to separate the door skin from the frame to provide for the replacement of the door skin and repair of the door. The invention includes moving the hem flange separation tool along the length of vehicle door hem flange of the vehicle door to reorient the vehicle door hem flange from the first angle of orientation to the second angle of orientation to separate the vehicle door skin from the door frame. The invention includes attaching a new replacement door skin on the door frame using a second tool applied along the length of the door frame to form a new hem flange so that the new replacement door skin is made integral with the reused door frame. The invention includes providing a replacement vehicle door skin vehicle door hem flange repair member with an open first angle of orientation with vehicle door frame between the replacement vehicle door skin and the vehicle door hem flange repair member with the vehicle door frame having a bead of adhesive. The bead of adhesive is positioned proximate the vehicle door hem flange repair member. The second repair tool forces the replacement vehicle door skin vehicle door hem flange repair member with an open first angle of orientation towards the vehicle door frame to reorient the hem flange repair member to its second angle of closed orientation with the vehicle door frame interleaved between the vehicle door hem flange repair member and the replacement vehicle door skin into its closed second angle of orientation with the applied adhesive sandwiched therebetween to form a repaired integral door. The second repair tool for reorienting the flange to the closed position includes a second tool support member and a second tool guide member defining a second tool vehicle door hem flange reorienting tool interior. The second repair tool includes a tapered reorienting surface tapered down into an orienting gap between a substantially planar orienting surface that is substantially parallel to a guide member. The second repair tool includes an attachment shaft for application of an actuating force to the tool to force the replacement vehicle door skin vehicle door hem flange repair member with the open first angle of orientation towards the vehicle door frame with the door frame between the replacement vehicle door skin and the hem flange repair member along with an applied adhesive. With the application of the attachment shaft actuating force the tapered reorienting surface forces the hem flange repair member vehicle door frame open angle of orientation closed along with the adhesive squeezed therebetween. The actuation of the tapered reorienting surface forces the hem flange repair member vehicle door frame into the orienting gap between the substantially planar orienting surface and the planar guide member to provide the vehicle door frame interleaved between the vehicle door hem flange repair member and the replacement vehicle door skin with a closed second angle of orientation with the applied adhesive sandwiched therebetween to form a repaired integral door. The invention includes the making of the vehicle body hem flange skin repair with the replacement vehicle skin by reusing the vehicle body frame. The invention includes the vehicle body skin hem flange repair kit comprised of the set of the first repair tool and the second repair tool utilized to make the vehicle body hem flange skin repair. The first tool provides for efficient separation of the damaged skin from the vehicle body frame and the second tool provides for the efficient reuse of the frame with a replacement vehicle skin and adhesive to integrate the replacement vehicle skin to the frame by forming a new reoriented repair hem flange.

The foregoing and other aspects will become apparent from the following detailed description of the invention when considered in conjunction with the accompanying drawing figures.

DETAILED DESCRIPTION OF THE PREFERRED EMBODIMENT

Figure 10B:
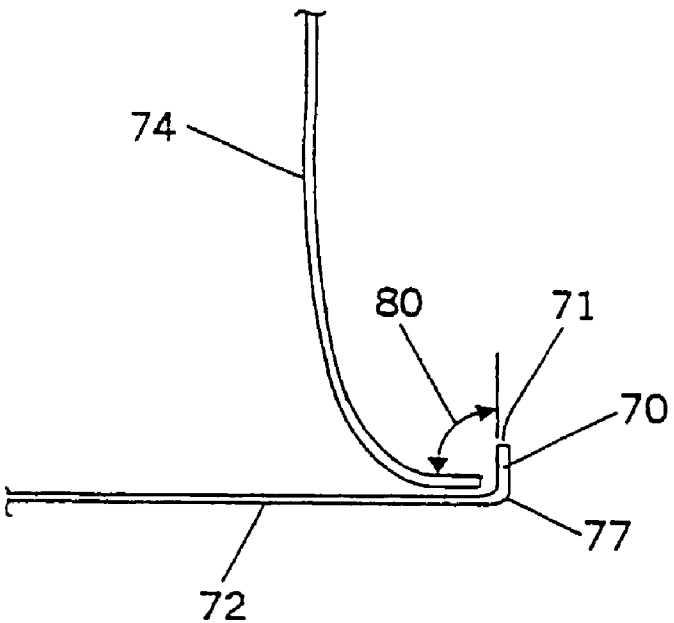
FIGS. 10A and 10B represent the relative positions between the door frame and hem flange before and after the application of the hem flange removal to the hem.
Figure 10A:
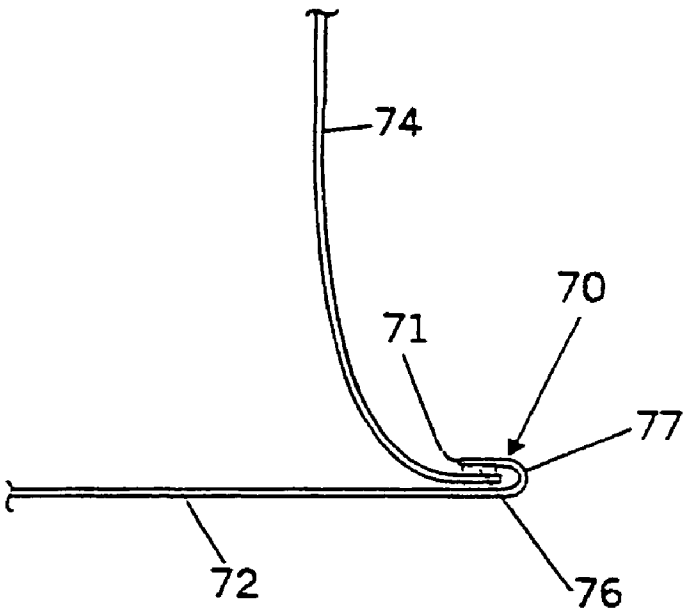

FIGS. 1-6 illustrate a preferred embodiment of the hem flange lifting separation first tool 10 of the present invention for separation of a hem flange of a vehicle door member that is to be repaired. The hem flange separation removal first tool of the present invention generally: (a) lifts flange 70 from a first angle of closed orientation; (b) lifts the free edge 71 of flange 70 and repositions the flange 70 away from frame 74 and finally (c) orients the flange 70 at an open angle 80, approximately equal to ninety degrees relative to the edge of frame 74 to allow removal of the skin and reuse of the frame 74. See FIGS. 10A and 10B. In step (a) as the hem flange separation removal tool is displaced, the hem flange separation tool may also break a bond between the flange and frame formed by bonded adhesive 76 as shown in FIG. 10A between the hem flange 70 of hem flange door skin 72 and door frame 74.

Figure 1:
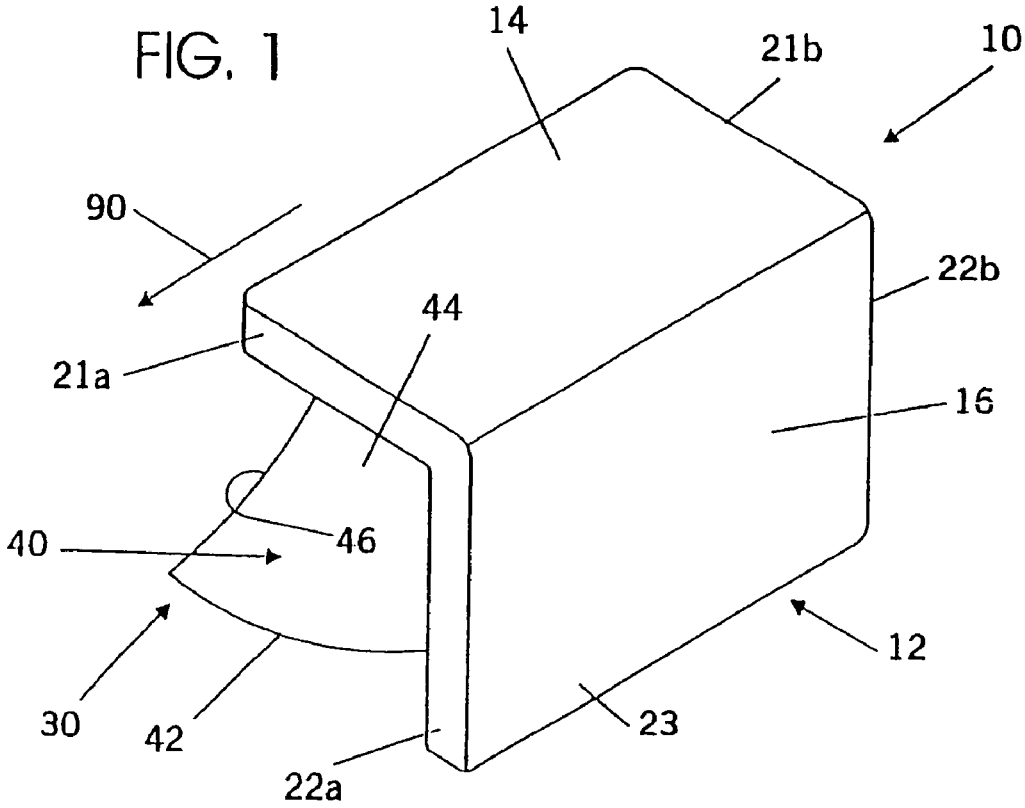
FIG. 1 is an isometric view illustrating the front, top and right side views of the hem flange removal first tool of the present invention.
Figure 2:
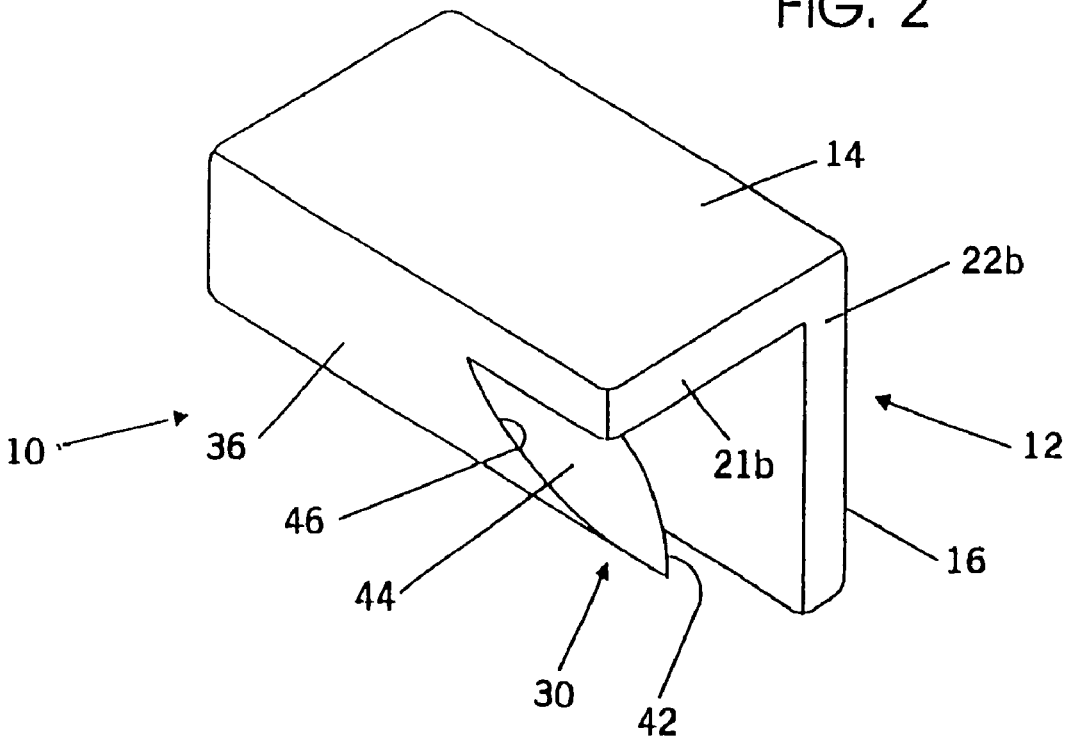
FIG. 2 is an isometric view of the hem flange removal tool of FIG. 1 illustrating the front, top and left side views of the first tool.
Figure 3:
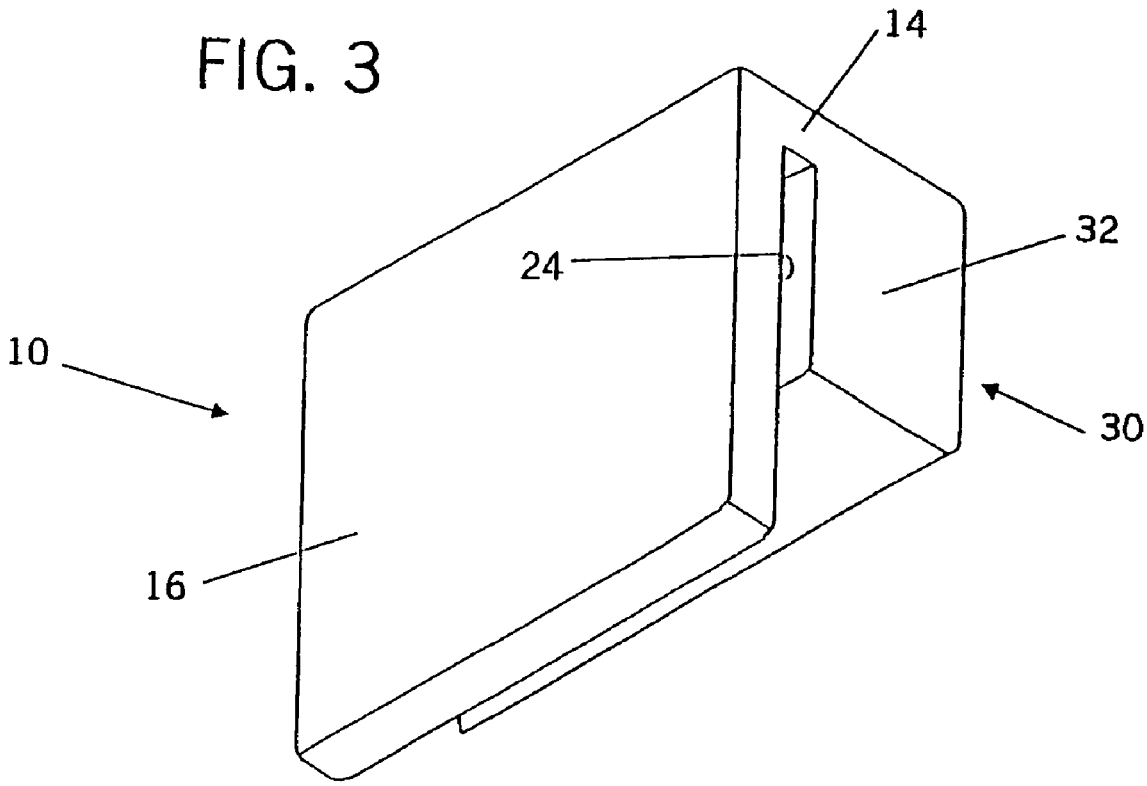
FIG. 3 is an isometric view of the hem flange removal tool of FIG. 1 illustrating the rear, bottom and right side views of the first tool.
Figure 4:
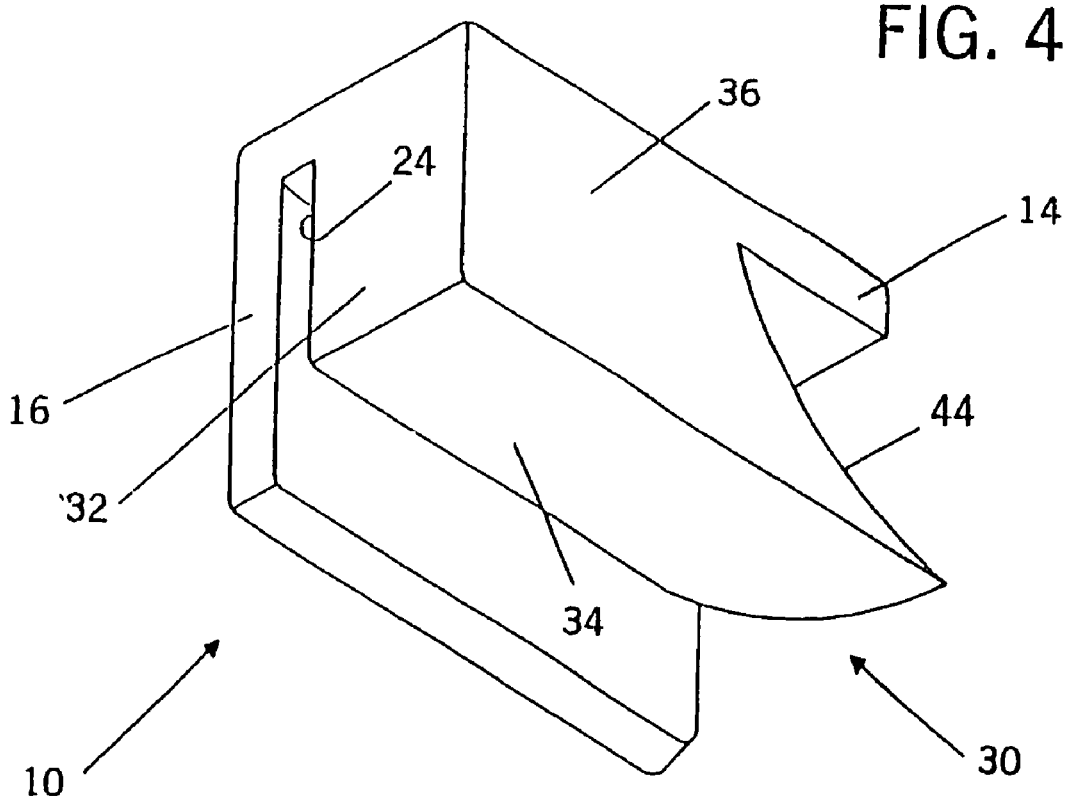
FIG. 4 is an isometric view of the hem flange removal tool of FIG. 1 illustrating the rear, bottom and left side views of the first tool.
Figure 5:
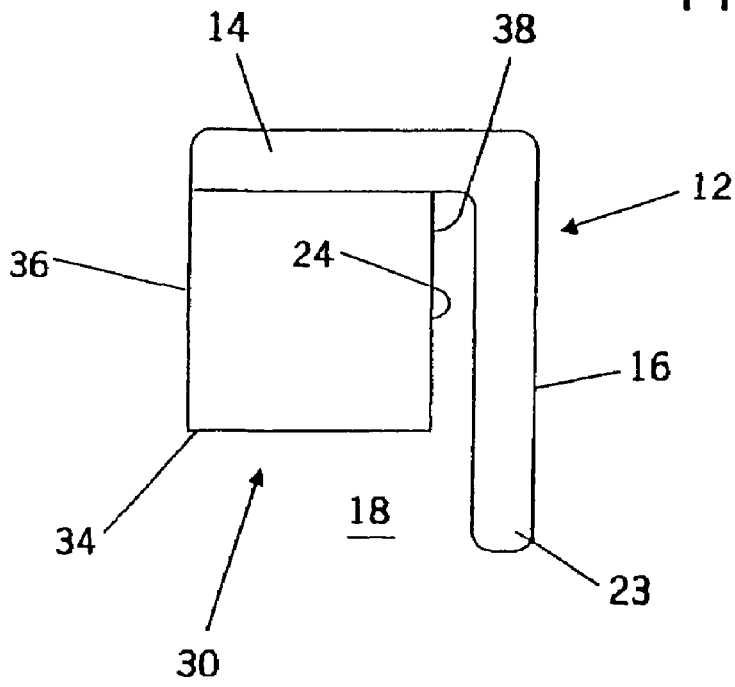
FIG. 5 is a front view of the first tool of FIG. 1.
Figure 6:
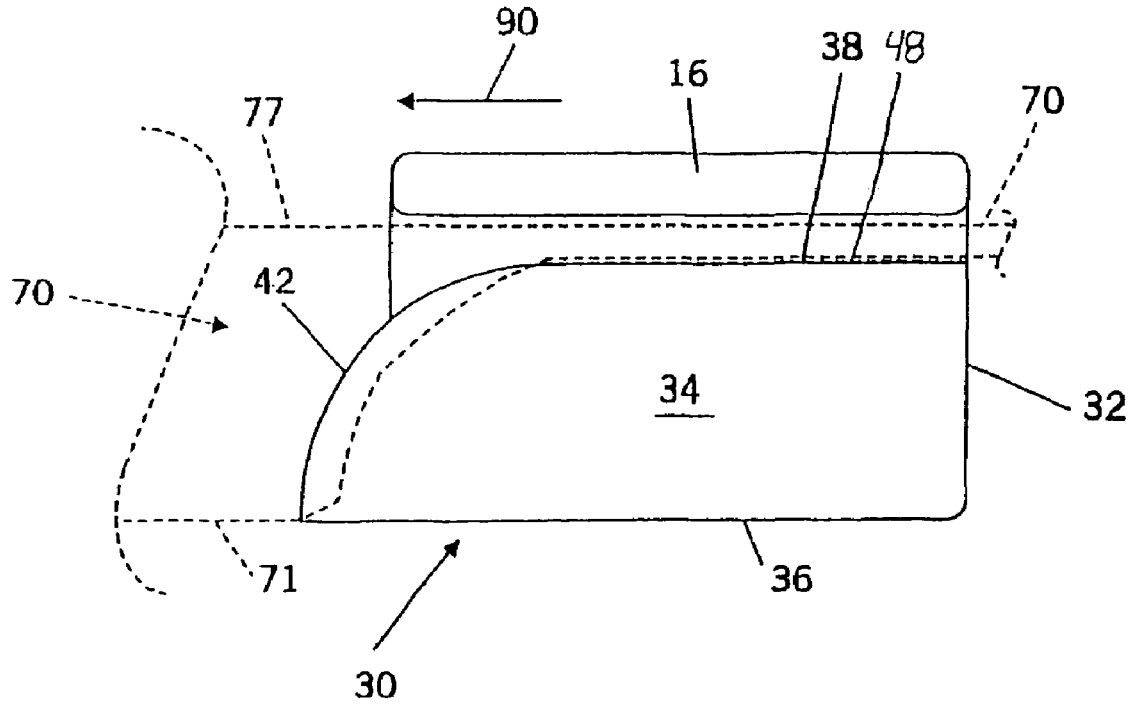
FIG. 6 is a bottom view of the hem flange removal first tool of FIG. 1.

The first hem flange separation tool 10 is unitary and is preferably made from a cast metal which most preferably is steel. The first hem flange tool 10 comprises an L-shaped guide support 12 that further comprises an upper support member 14 and downwardly extending guide member 16. As shown in FIG. 5, the support member 14 and guide member 16 define a first hem flange tool interior 18. As shown in FIGS. 1 and 6 during use, the hem flange first tool is displaced along flange 70 in direction 90, and the members 14 and 16 each have respective leading and trailing surfaces corresponding with the direction of travel and the surfaces are identified as 21*a*, 21*b* for member 14 and 22*a*, 22*b* for member 16.

Figure 8:
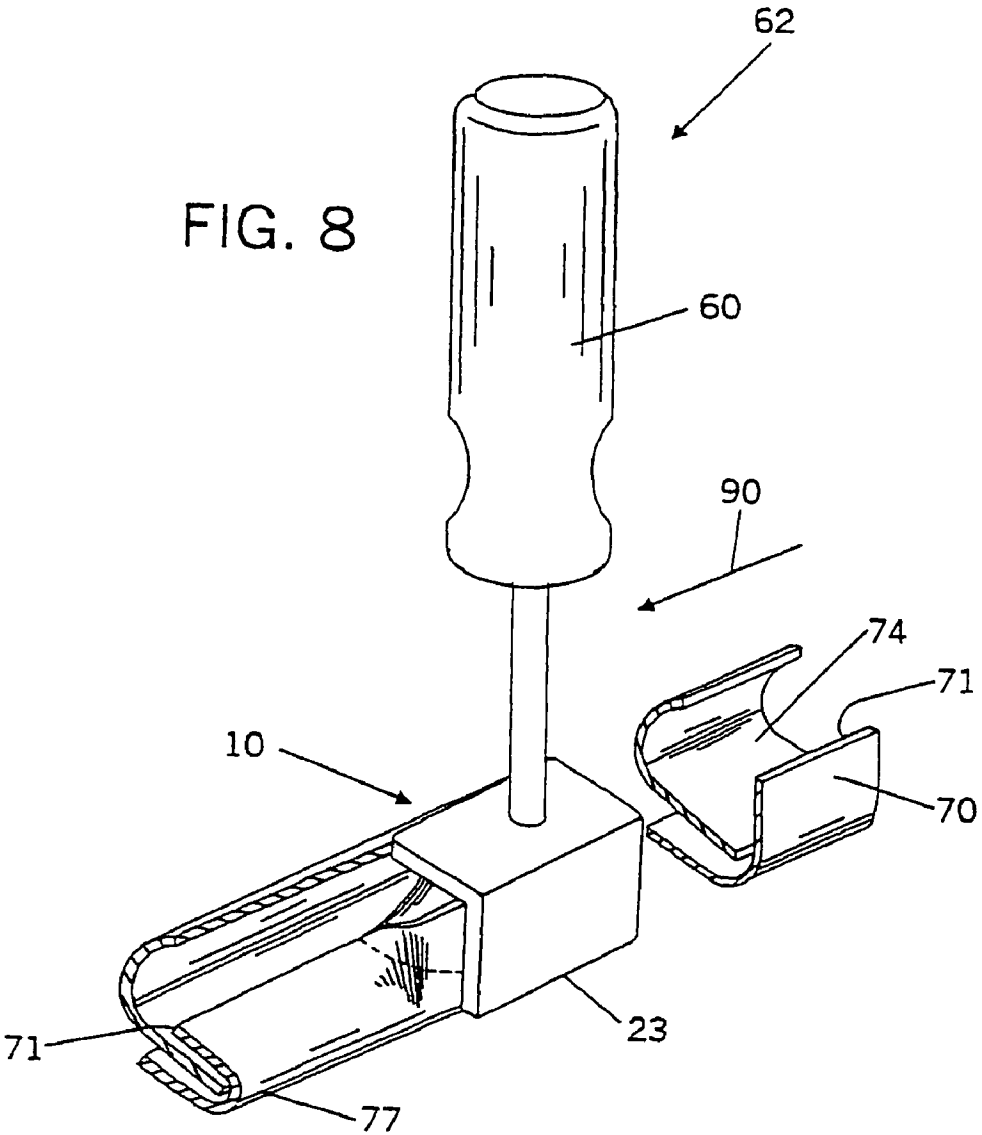
FIG. 8 is a schematic representation of a manually actuated hem flange removal first tool as it is moved along the hem flange.
Figure 9:
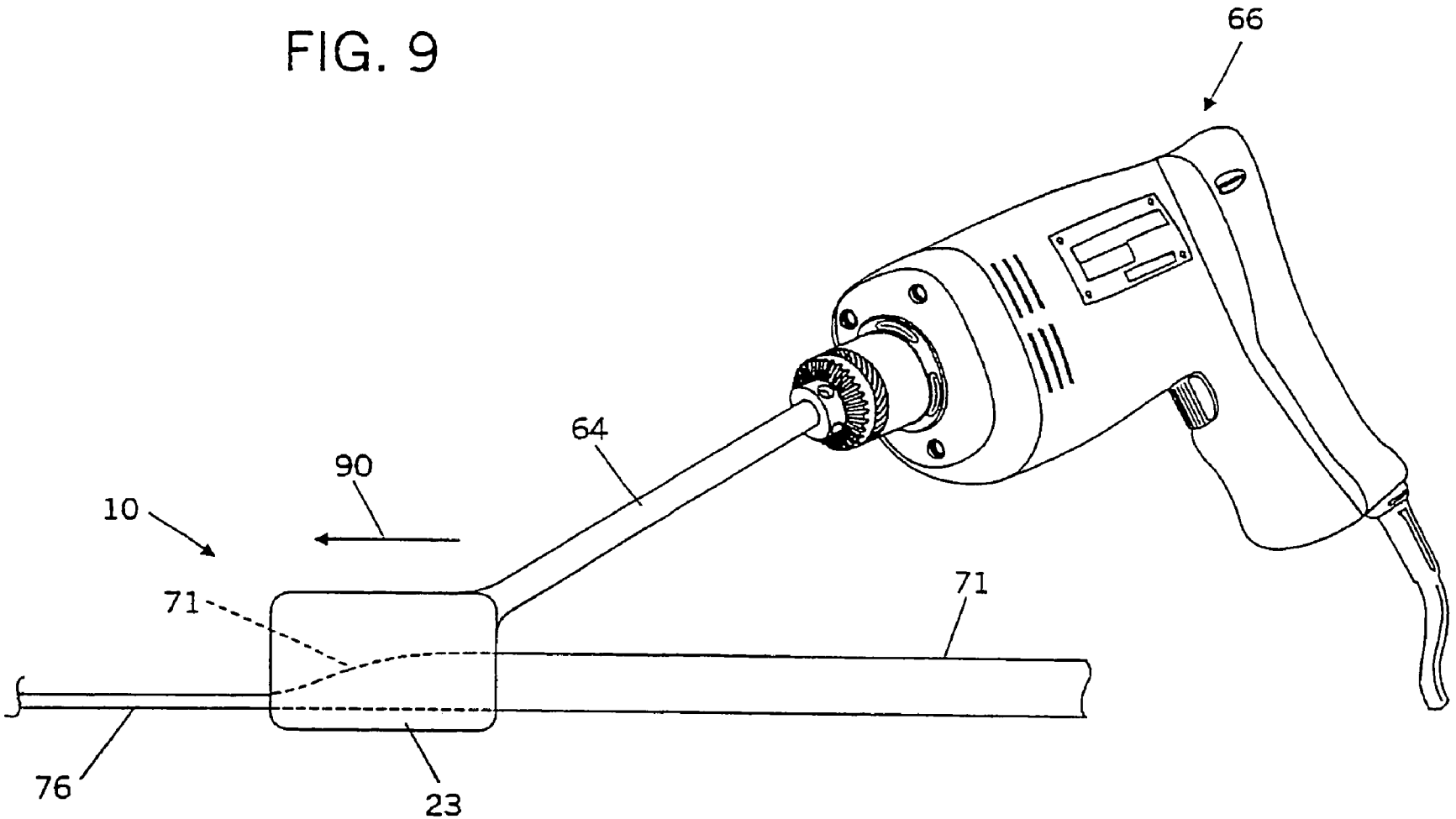
FIG. 9 is a schematic representation of a pneumatically actuated hem flange removal first tool as it is moved along the hem flange.

The unitary hem flange removal tool 10 also comprises shoe member 30 that is supported by member 14 and extends into interior 18. The shoe is spaced away from guide member 16 by an orienting gap or channel 24. The first tool 10 comprises rear surface 32, bottom surface 34 exterior longitudinally extending surface 36 and interior longitudinally extending surface 38. The surfaces 32, 34, 36 and 38 are substantially planar. As shown most clearly in FIG. 5, the interior longitudinal surface 38 is substantially parallel to guide member 16 and in this way the surface 38 and member 16 define an orienting gap 24 that has a substantially constant lateral dimension. The orienting gap is of sufficient magnitude to allow the hem flange 70 to pass uninterrupted through the first tool 10 as the flange is reoriented to the position shown in FIG. 10B. By reorienting the flange at an angle of approximately 90° relative to the door frame, the skin can be easily removed from the frame and discarded and the frame reused with a replacement skin. The guide member 16 terminates at a tail portion 23 below the plane defined by bottom surface 34. The guide member tail portion 23 extends below the flange bend 77 as shown in FIGS. 8 and 9 and overlaps the flange to ensure the shoe is maintained within the flange and also decrease the chance the tool will lift or jump out from within the flange as the tool is displaced along the flange length. Therefore, the hem flange removal tool is more stable than if the guide 16 terminated aligned or substantially aligned with the bottom surface 34.

The shoe further comprises a contoured leading lateral surface 40. The leading lateral surface is defined by a relatively sharp leading edge 42 and an inwardly tapered repositioning surface 44 behind the leading edge. As shown in FIG. 6, the leading edge 42 has an arcuate configuration and extends about ninety degrees (90°) between longitudinal surfaces 36 and 38. A portion of the leading edge extends outwardly beyond the leading faces of members 14 and 16. The leading edge is relatively sharp and in this way the edge may be effectively inserted beneath the flange between the flange 70 and door frame 74 as will be described in greater detail hereinafter. Also, the sharp leading edge scrapes a significant portion of any adhesive off of the frame 74 making cleaning the frame and preparing the frame for a simpler repair process and provides for efficient replacement with the new skin reoriented with a new hem flange with the second hem flange reorienting tool 110 of the tool kit.

The inwardly tapered repositioning surface 44 joins longitudinal sides 36 and 38. The surface 44 is bound longitudinally at surface 36 by first edge 46 and at surface 38 by edge 48 and both edges are oriented substantially in the direction of travel of hem flange removal tool 10. The inwardly tapered "scoop like" configuration of surface 44 spans an angle of about ninety (90°) degrees between sides 36 and 38 and at edge 48 the surface is directed substantially perpendicular to the direction of the hem flange removal tool travel 90. As a result, as the hem flange removal tool 10 is directed along hem 70, the portion of surface 44 at edge 46 serves to lift the flange from the frame, and then as the hem flange removal tool 10 is inserted further into the flange and the flange travels along the surface 44, the reorienting surface 44 contour redirects and further displaces the flange 70 away from the frame until the flange is inserted in channel or orienting gap 24.

The hem flange removal tool 10 may be made integral with handle 60 of manually actuated tool 62 shown in FIG. 8. Alternatively, as shown in FIG. 9, the hem flange removal tool 10 may be made integral with shaft member 64 which in turn is actuated by a pneumatically actuated device 66 such as an air hammer for example. As shown in FIG. 9, the shaft is oriented at an angle relative to the direction of displacement 90 for the hem flange removal tool 10.

Operation of hem flange removal tool 10 will now be described.

Figure 7:
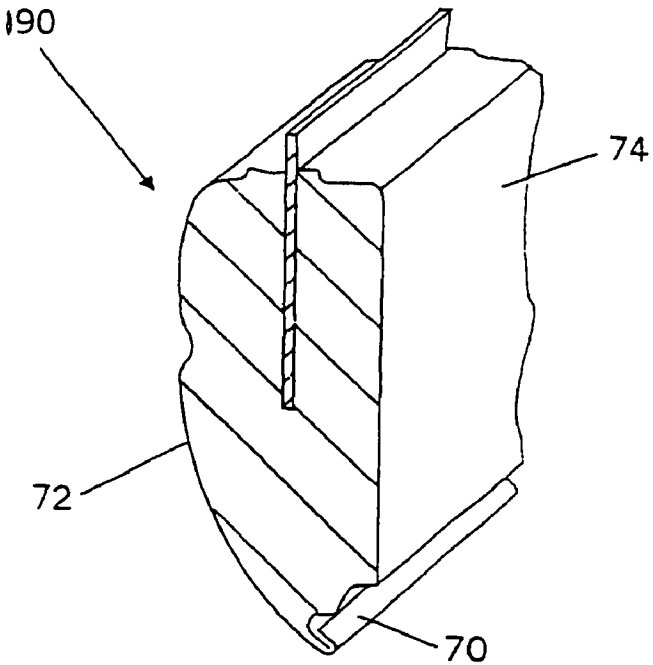
FIG. 7 is an isometric schematic partial representation of the attached door frame and door skin.

The tools actuations devices 62 and 66 serve as the means for moving the tool through the closed hem flange 70. Operation of hem flange removal tool 10 is substantially the same for the manually and pneumatically actuated tool devices 62 and 66 and therefore as the description of the operation of the invention proceeds, the operation of tool will be described without specific reference to the means for moving the tool through the hem flange either tool actuation device 62 or actuation device tool 66. When the skin of door 190 has been damaged or it is for other reasons necessary to remove the skin from the door frame 74, the flange must be moved away from the frame in order to separate the skin from the frame. If the flange is bonded to the frame the bond between the hem flange and door frame must be broken before the hem flange is reoriented away from the door frame 74. A schematic representation of a portion of a door 190 is shown in FIG. 7. For purposes of describing the operation of the preferred embodiment of the invention it is assumed that the flange and frame are bonded by adhesive 76. The flange and frame may alternatively be tack welded. After removal of the damaged door skin a new replacement door skin 72 is made integral with door frame 74 with hem flange reorienting tool 110 as shown in FIGS. 11-16.

The hem flange removal tool 10 is oriented so that the guide 14 is located against the closed side of the flange and against bend 77. As shown in FIGS. 8 and 9, the tail portion 23 extends below bend 77 to ensure the shoe remains in the desired location between flange 70 and frame 74 as the hem flange removal tool 10 is moved and the flange is reoriented open. At this time the flange in bonded to door frame 74 by adhesive 76 as shown in FIG. 10A. The leading shoe edge 42 is inserted under the flange 70 between the flange and door frame. The motive force required to displace hem flange removal tool 10 in direction 90 between the flange and door frame is applied by pneumatic tool 66 or manually actuated tool 62.

As previously mentioned, the hem flange removal tool separates and reorients the flange in three operations or steps as it is moved along the hem. First, it lifts the flange (if bonded, the bond is broken between the hem and door frame before the lifting step is executed). Second, the shoe repositions the flange away from the door frame. Finally, the hem flange removal tool 10 reorients the flange so that the flange does not interfere with the skin removal from the frame. The bond is broken as the leading edge 42 pierces and is driven through the adhesive layer 76. Then, as shown in greatest detail in FIG. 8, the free edge 71 of flange 70 is urged outwardly as the reorienting surface 44 passes under the flange. When the free edge of the flange travels downstream to edge 48, the flange is substantially oriented at the angle shown in FIGS. 8 and 9. The flange is then passed through channel 24 whereby the hem is reoriented to the desired final angle of open orientation. The flange is displaced from a first angle of closed orientation shown in FIG. 10A to a final angle of open orientation shown in FIG. 10B for removal of skin 72. The difference between the first and second angles of orientation is approximately ninety degrees. It should be understood that although an angle of ninety degrees (90°) is shown and described, the difference between angles of orientation for the resultant reoriented flange may be any suitable relative angle between allowing removal and replacement of the damaged skin to be repaired. As shown in FIG. 10B the door frame and flange are separated by about ninety degrees. It has been determined by the inventor that an open angular difference of ninety degrees allows for the most effective, uninhibited separation of the skin and door frame.

Figure 11:
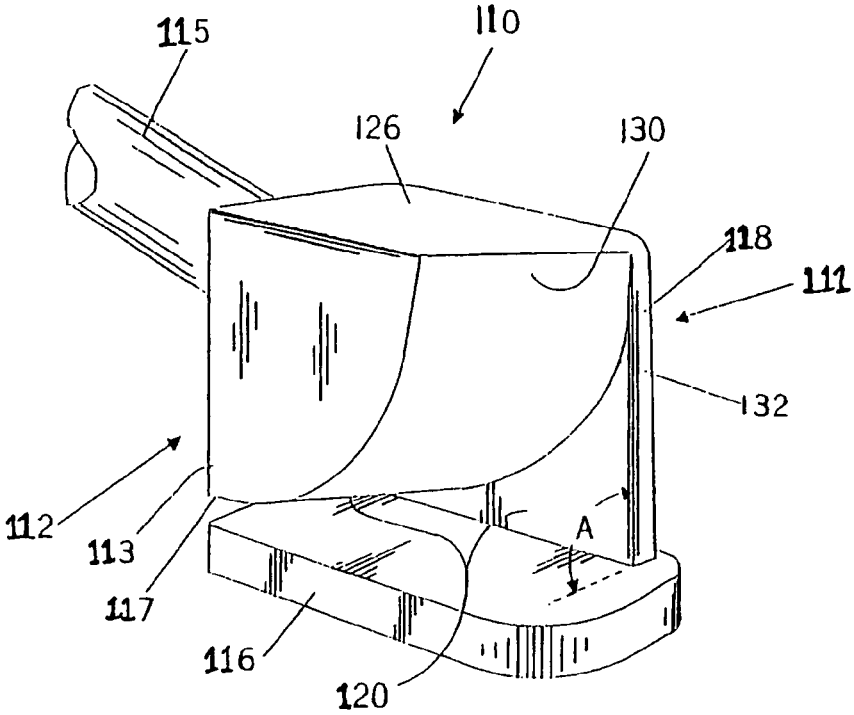
FIG. 11 is an isometric view illustrating top, front and left side views of the flange reorienting second tool of the present invention.
Figure 12A:
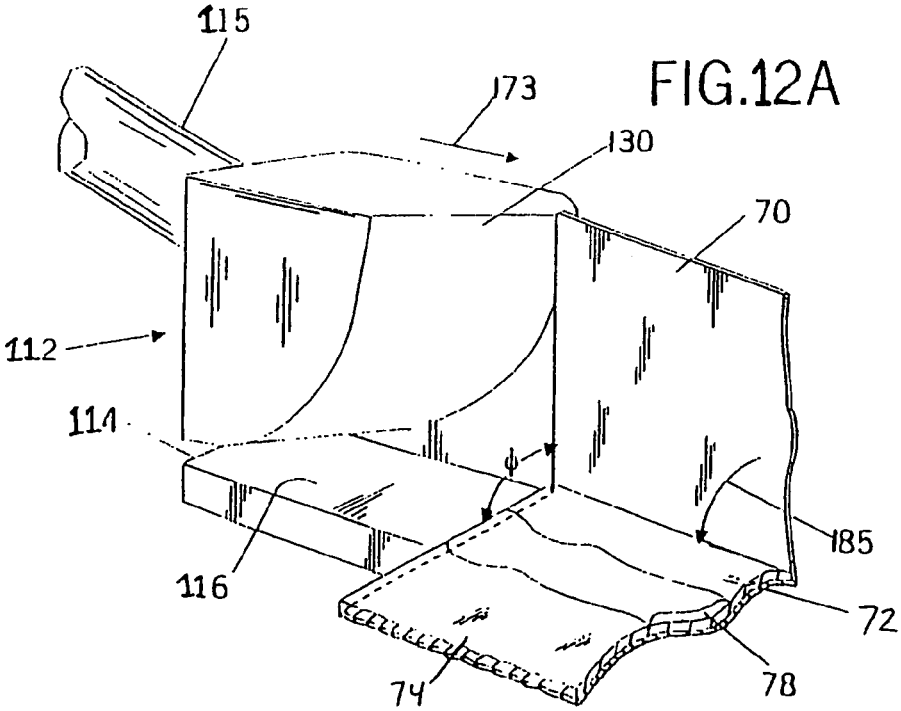
FIG. 12A is an isometric view of the flange reorienting second tool of the present invention as shown in FIG. 11 and also includes a segment of a typical interleaved door frame and skin with a flange in an initial orientation, and illustrates an initial step in the method for reorienting the flange as the flange contacts the leading portion of the tool as the tool is displaced along the interleaved frame and skin segment.
Figure 12B:
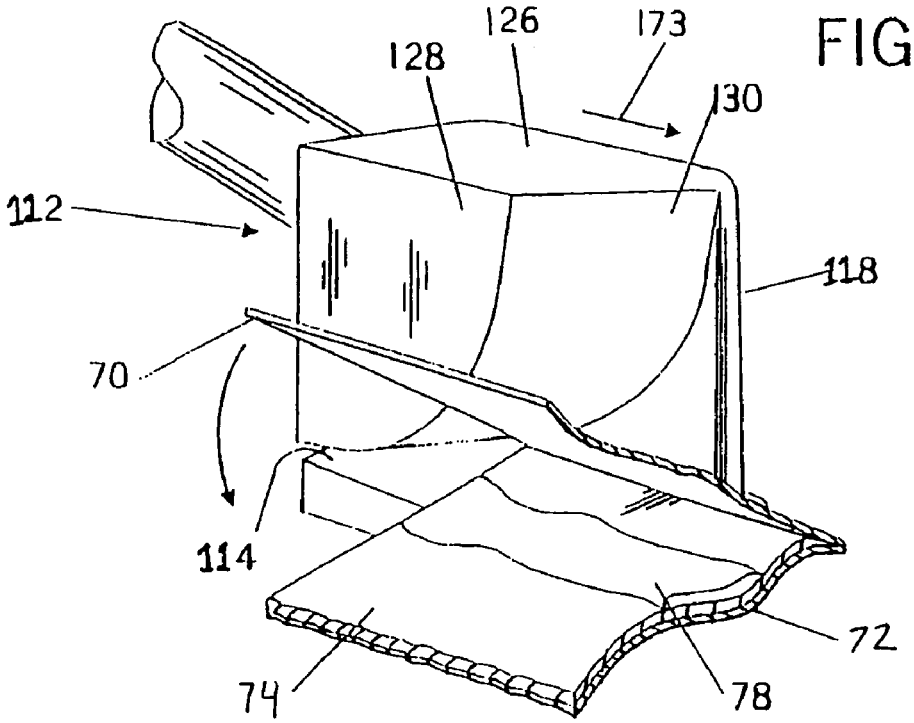
FIG. 12B is the isometric view as shown in FIG. 12A and illustrates an intermediate portion of the method for reorienting the flange as the flange segment is partially reoriented by the second tool as the tool is displaced along the length of the interleaved frame and skin segment and the flange segment is in contact with the tool reorienting surface.
Figure 12C:
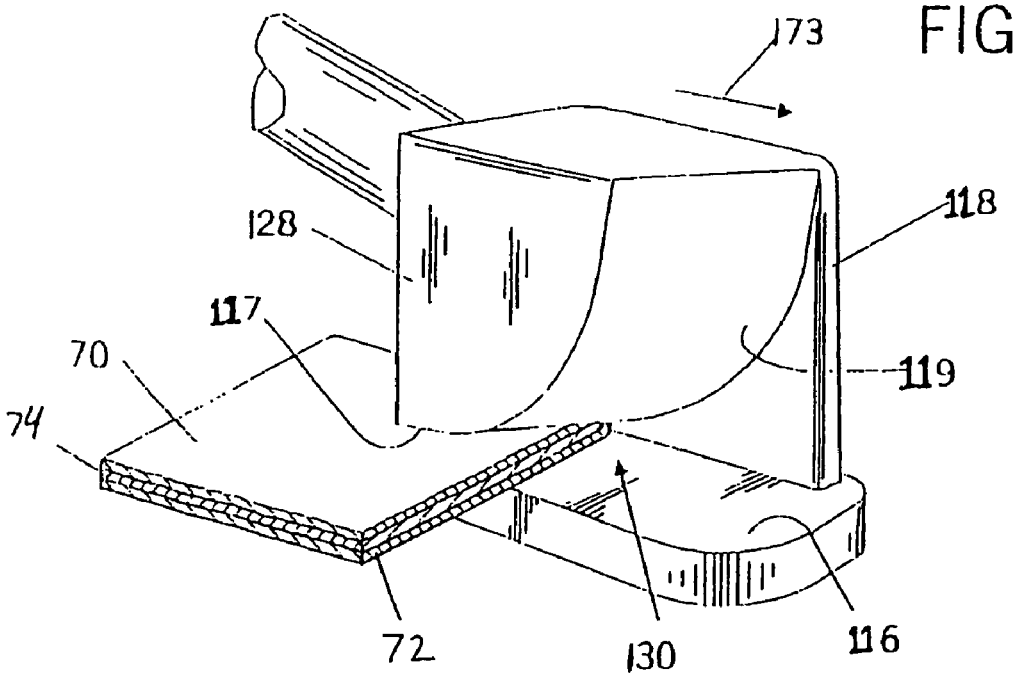
FIG. 12C is the isometric view as shown in FIG. 12A and illustrates a final portion of the flange reorienting method as the second tool is moved over the interleaved frame and skin segment and the flange is reoriented to a desired final orientation.

The invention includes reorienting a new hem flange of a new door skin on the vehicle door frame. The invention includes removing a damaged door skin using the first hem flange removal tool 10 and replacing with a replacement door skin by reorienting a new replacement hem flange with the second hem flange reorienting tool 110. The vehicle door skin hem flange repair kit of the invention is comprised of hem flange removal first tool 10 and second hem flange reorienting tool 110. The invention relates to a tool kit set, devices and methods for repairing and reorienting vehicle body panel skin members such as a hem flange located along the outer periphery of a vehicle door skin where the reoriented hem flange, in combination with an adhesive applied at the flange, maintain the door frame and outer door skin integral. FIGS. 11-13C illustrate a preferred embodiment of the flange reorienting second tool 110 of the present invention for repairing a vehicle door skin. The repair methods of the present invention utilizing reorienting tool 110 is generally represented in FIGS. 12A-12C, 15, 16A, 16B for reorienting an open flange to a closed flange with the replacement door skin attached to the reused door frame. The second tool of the repair kit is a flange reorienting tool 110 for closing an open flange to make an integral vehicle door skin and frame. As shown in FIGS. 12A-12C the flange reorienting tool of the present invention generally: (a) contacts the open flange 70 which is oriented open in an initial orientation at a first angle, Ø, relative to the door skin 72 and door frame 74, as the tool is moved along the flange in direction 173 as shown in FIG. 12A; (b) progressively urges the flange 70 toward the skin 72 and frame 74 as the flange further contacts leading reorienting surface 119 of tool shoe member 112 as the tool 110 is further displaced in direction 173, see FIG. 12B and (c) finally reorients the flange 70 to the closed orientation shown in FIG. 12C as the flange passes through the gap 114 defined between the substantially planar trailing reorienting shoe surface 117 and guide member 116 so that in its final orientation the flange and door frame are in an interleaved configuration. As the description proceeds, for simplicity, throughout the drawing Figures, only a portion of the flange 70, skin 72 and frame 74 are shown. However, it should be understood that the functionality of the tool as related to the reorientation of the illustrated flange, skin and frame section applies to the skin, frame and flange along their entire respective lengths.

The second flange reorienting tool 110 of the present invention is unitary and is preferably made from a metal and is most preferably made from a forged steel. The flange closing reorienting tool 110 comprises an L-shaped guide support 111 that further comprises an upwardly extending support member 118 and guide member 116 that is substantially perpendicular to the support member 118. The support member 118 and guide member 116 define a flange reorienting tool interior 120. Although the guide support 111 is disclosed as having an L-shaped configuration with support 111 and member 116 being separated by an angle, A of about ninety degrees, it should be understood that the support 111 and member 116 may be separated by any suitable relative angle.

Figure 13B:
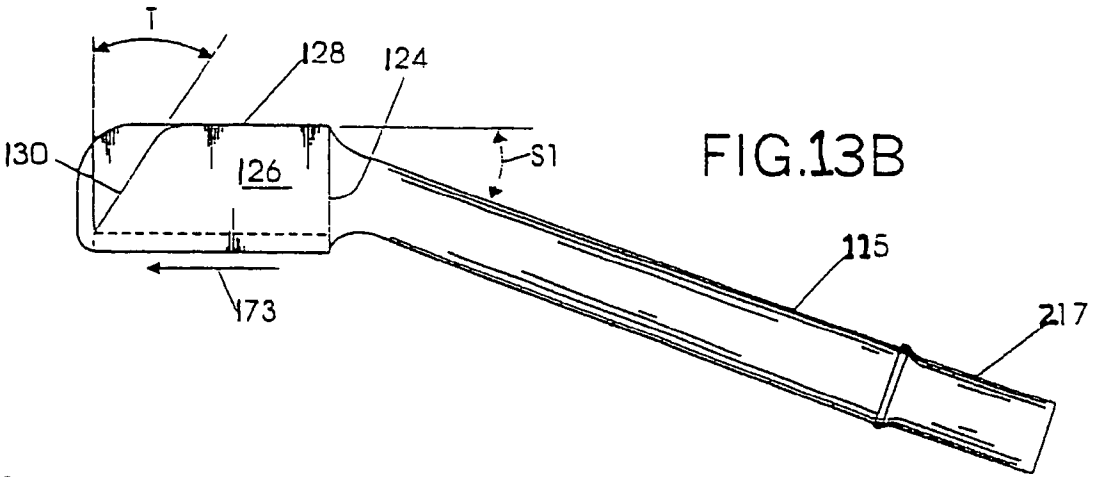
FIG. 13B is a top view of the reorienting second tool of the present invention illustrated in FIG. 11.
Figure 13C:
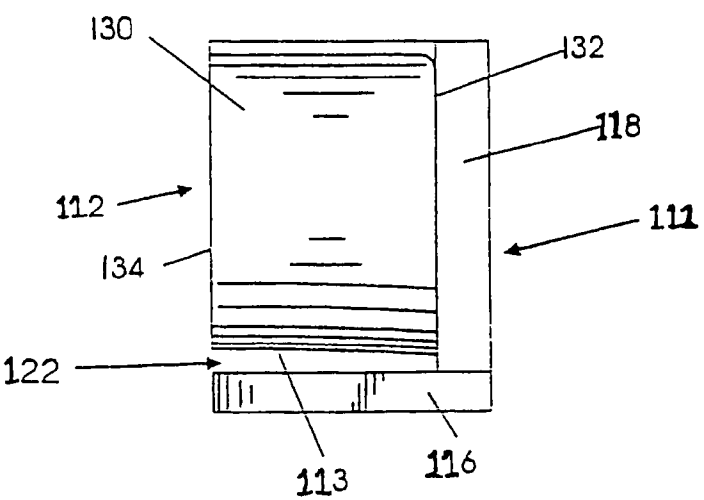
FIG. 13C is a front view of the reorienting second tool of the present invention shown in FIG. 11.
Figure 13A:
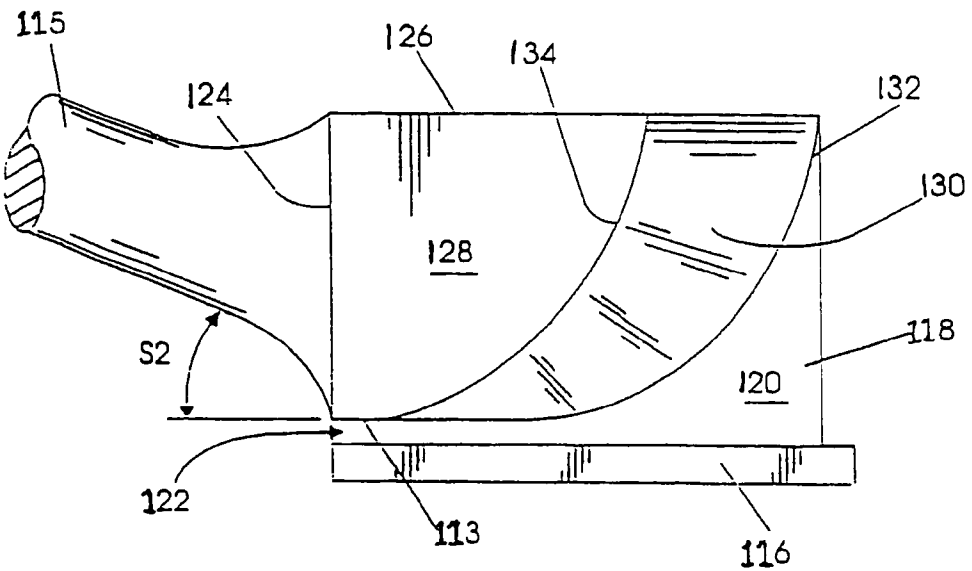
FIG. 13A is a left side view of the reorienting second tool of the present invention illustrated in FIG. 11.

As indicated above, unitary flange reorienting second tool 110 also comprises shoe member 112 that is supported by member 118 and the shoe extends outwardly from member 118 into the defined tool interior 120. As shown in FIG. 13C, shoe 112 is spaced away from guide member 116 and at the trailing portion of 113 of the shoe 112 the shoe includes a substantially planar trailing orienting surface 117 that is substantially parallel to the guide member 116 and in combination with the guide member 116 define an orienting gap 122. The surface 117 and guide member 116 are separated by a distance sufficient to facilitate the smooth passage of the interleaved portions of the door frame 74, door skin 72 and reoriented flange 70 through the reorienting gap 122.

The shoe 112 comprises rear surface 124, top surface 126 and exterior side surface 128, and the surfaces 124, 126 and 128 are substantially planar. An attachment shaft 115 extends outwardly from the rear shoe surface, at an angle identified as S1, of about twenty-five degrees (25°) relative to surface 128 and at an angle S2 of about thirty degrees (30°) relative to the rear surface 124. The shaft is connected to a means for displacing the flange closing reorienting tool along the flange. Orienting the shaft 115 at relative angles S1 and S2 locates the free, attachment end 217 of the shaft away from the flange closing reorienting tool body and as a result ensures that the tool actuation means is located away from the flange and does not interfere with the flange reorientation as the flange reorienting tool is displaced along the interleaved frame and skin. The actuation means attached to the shaft 115 at end 217 may be a conventional pneumatically actuated hammer pneumatic tool device 66 as shown schematically in FIG. 15 for example. With additional fixturing, the second tool 110 may be hand held or manually manipulated. However due to the complexity associated with fixturing such a manually manipulated device, the preferred mode of actuation is through a means such as the pneumatic device 66 of FIG. 15.

Returning to drawing FIGS. 11-13C, the shoe 112 comprises a unitary reorienting surface 130 that further comprises a substantially semi-frustoconical leading reorienting surface 119 and a substantially planar trailing reorienting surface 117. By tapering the leading reorienting surface inwardly in the direction of displacement, the leading reorienting surface serves to progressively reorient the flange from its initial orientation to an intermediate orientation in which it is located in the reorienting gap. The planar trailing reorienting surface is located downstream from the leading reorienting surface in the direction of motion 173. The leading portion 119 of the reorienting surface 130 tapers inwardly as it extends from the guide member 118 to the exterior side surface 128 at an angle T, which may be about forty-five degrees (45°) for example. The taper angle T, is shown in FIG. 3B. As shown in FIG. 11 the leading edge 32 of the leading reorienting surface is located proximate the guide member 118. The reorienting surface 130 spans an angle of ninety degrees (90°) between top and rear surfaces 126 and 124. The contour of the leading reorienting surface is arcuate as the surface extends longitudinally. The contoured reorienting surface 130 extends outwardly, laterally from the support member 118 and joins the top, side and rear surfaces. The trailing reorienting surface 117 extends longitudinally between the leading reorienting surface 119 and the rear surface 124. For reference purposes, the lateral direction as referred to hereinafter is substantially perpendicular to the direction of tool displacement 173, and the longitudinal direction is generally aligned with the direction of the flange closing reorienting tool displacement. As a result of the generally arcuate, tapered contour of the reorienting surface 130, the flange reorienting tool 110 of the present invention produces gradual, precise and effective reorientation of the flange member 70. The reorientation of the flange from its initial orientation to an intermediate orientation in which it is located in the reorienting gap is achieved smoothly and progressively by the flange reorienting tool 110.

Operation of second flange reorienting tool 110 will now be described.

The second flange reorienting repair tool 110 of the present invention serves to reorient a flange in a precise, effective and efficient manner regardless of the means used to actuate or displace the flange reorienting repair tool along the flange. Therefore, as the description of the operation of tool proceeds the pneumatic tool device 66 of FIG. 15 will be described as the actuation means however it should be understood that any suitable actuation device may be utilized to actuate and displace the flange reorienting tool 110 in order to reorient a flange. Also, as the description of the use of the second flange reorienting repair tool 110 proceeds the description will comprise use of the tool 110 to reorient a hem flange in a vehicle door. It should be understood however that such use is exemplary and the description of such specific use is made in order to provide a description of a preferred embodiment of the invention, and the flange reorienting repair tool 110 may be used to reorient vehicle flanges in a variety of vehicle repair applications, preferably vehicle door skin replacements. It should be understood that the edges between adjacent flange reorienting repair tool surfaces are rounded and smooth and are not sharp. In this way the flange reorienting tool 110 does not gouge the door and flange as the tool is moved along the hem flange.

Figures 14, 15:
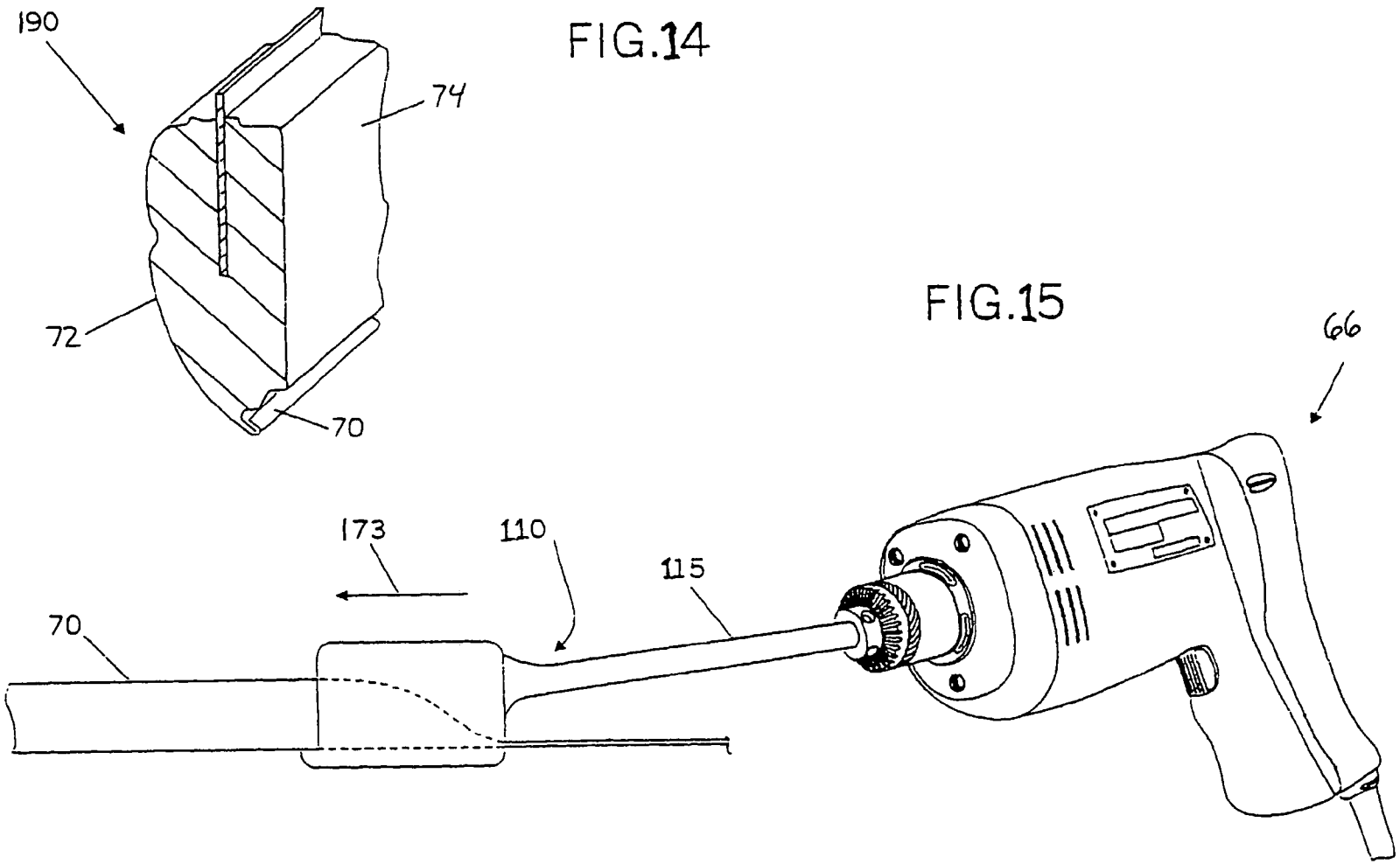
FIG. 14 is a schematic representation of a partial section of a vehicle door illustrating the attached door frame and door skin.
FIG. 15 is a schematic representation of the second tool of the present invention attached to a pneumatically actuated device.
Figure 16B:
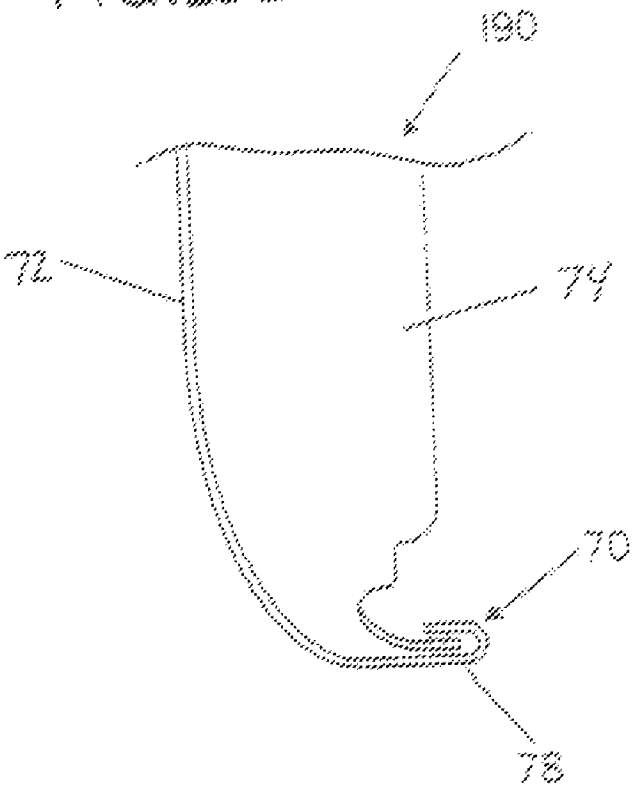
FIGS. 16A and 16B respectively represent the relative positions between the door frame and flange before and after the flange reorienting second tool is moved across the interleaved frame and flange.
Figure 16A:
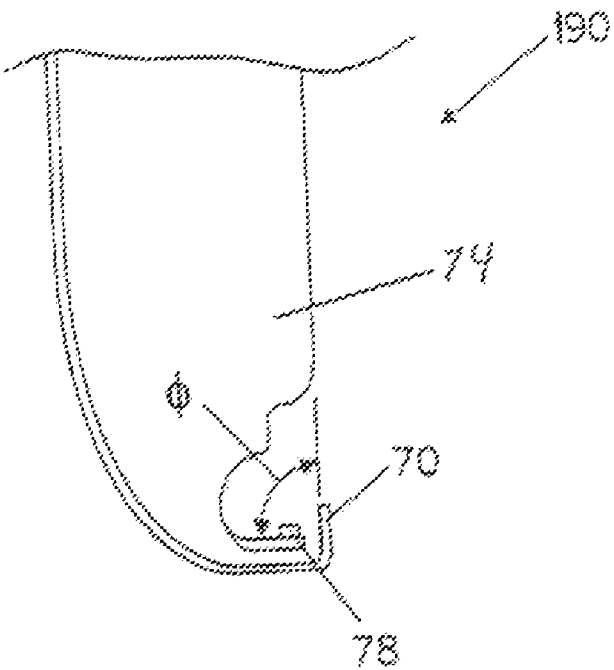

Turning to FIGS. 14, 16A and 16B, after the skin 72 of door 190 has been repaired and replaced in accordance with the invention and it is necessary to make the skin 72 and frame 74 integral, the flange reorienting tool 110 is moved along the flange to reorient the flange 70 against the frame. As shown in FIG. 16A, the angle of separation between flange 70 and frame 74 identified by Ø, is equal to about ninety degrees (90°). The flange reorienting repair tool 110 of the present invention is suited to reorient a flange oriented at any angle having a value that is greater than zero and less than ninety degrees. For purposes of describing the present invention, as illustrated in FIGS. 16A and 16B, the flange 70 is reoriented ninety degrees by flange reorienting tool 110, however the tool may be modified to reorient flange 70 or any flange by any desired angle.

For purposes of describing the operation of the preferred embodiment of the invention it is preferred that the flange and frame are bonded by adhesive 78, and that as the flange is reoriented the adhesive 78 between the flange 70 and frame 74 is sandwiched therebetween and serves to produce the required bond between the frame and flange.

After the skin 72 is properly located along the frame 74, a bead of a suitable adhesive 78, such as Fusor® adhesive sold by Lord Corporation of Erie, Pa., is placed along the periphery of frame 74 proximate the flange member 70.

The entire flange length is reoriented in the same manner so for brevity, only the reorientation of the flange end shown in FIGS. 12A-12C will be described. The second flange reorienting tool 110 is located at one end of the flange 70 and oriented at the flange end with the flange 70 located against the support member 118 and the skin 72 seated on the guide member 116 such as in the manner illustrated in FIG. 12A. The flange is in an initial orientation with flange end 70 in contact with the leading orienting surface 119 proximate the leading edge 132. As flange reorienting tool 110 is displaced by the actuation means device 66 in direction 173, the flange end is progressively and smoothly urged toward frame 74 in direction 185 of FIG. 12A. Further displacement of second tool 110 in direction 173 moves the flange segment further along leading reorienting surface 119 and thereby progressively reorients the flange closer to frame 74 to an intermediate orientation between the initial and final flange orientations. See FIG. 12B. The smooth progressive reorientation of the flange toward frame 74 continues until the flange 70, frame 74 and skin 72 are interleaved. Final reorientation occurs when the interleaved flange, frame and skin pass through the reorienting gap 122 between guide member 116 and trailing reorienting surface 117. The bead of adhesive 78 squeezed between the flange 70 and frame 74 serves to maintain the flange segment against the frame. In its final orientation, the flange 70 is essentially parallel to the frame 74.

The process is repeated along the entire length of the flange.

The invention includes a vehicle body skin hem flange repair kit comprised of a first repair tool 10 and a second repair tool 110 for efficiently repairing a damaged vehicle door skin with a replacement vehicle door skin. The invention includes replacement repairing a damaged vehicle door skin with a replacement vehicle door skin utilizing the set of first repair tool 10 and second repair tool 110. The invention includes providing a first repair tool 10 comprised of a hem flange separation tool for reorienting said vehicle door hem flange from a first angle of orientation to a second angle of orientation as shown in FIGS. 1-10. The hem flange separation tool 10 has a separation tool leading edge 42 adapted to be located between the damaged vehicle door skin flange 70 and the door frame 74 of the door to be repaired. The leading edge 42 is a sharp edge that provides for beneficial and effective insertion between the door skin flange 70 that is to be separated from the door frame 74 that is to be reused with a replacement door skin. The leading edge 42 is driven along the hem flange of the door and provides for separation of the door skin flange 70 from the door frame 74 and piercing of existing cured adhesive layer 76 and breaking of the adhesive layer bond 76 between the flange and the door frame. The leading edge 42 provides for scraping a significant portion of the existing cured adhesive layer 76 off of the door frame 74 for efficient reuse of the door frame with a replacement door skin made integral with the reused door frame using an applied adhesive 78 and second tool 110. The hem flange separation tool 10 has a separation tool guide member for maintaining proper orientation of the tool and leading edge 42 as leading edge 42 is driven along the length of the hem flange. The hem flange separation tool guide member 16 and leading edge 42 are maintained in a separation tool orientation by the body of hem flange separation tool 10 in order to insure proper application of leading edge 42 in the separation of flange 70 from door frame 74. The hem flange separation tool guide member 16 is position relative to the leading edge 42 to provide guidance for the leading edge along the hem flange as hem flange separation tool 10 is driven in actuation direction 90 to separate the door skin 72 from the frame 74 to provide for the replacement of the door skin and repair of the door 190. The invention includes moving hem flange separation tool 10 along the length of vehicle door hem flange 70 of said vehicle door 190 to reorient said vehicle door hem flange from the first angle of orientation to the second angle of orientation to separate the vehicle door skin from the door frame 74. As shown in FIGS. 11-16, the invention includes attaching a new replacement door skin 72 on the door frame 74 using a second tool 110 along the length of the door frame 74 to form a new hem flange 70 so that the new replacement door skin 72 is made integral with the reused door frame 74. The invention includes providing a replacement vehicle door skin vehicle door hem flange repair member 70 with an open first angle of orientation with vehicle door frame 74 between the replacement vehicle door skin 72 and said vehicle door hem flange repair member 70 with vehicle door frame 74 having a bead of adhesive 78. The bead of adhesive is positioned proximate vehicle door hem flange repair member 70. The invention includes providing a second repair tool 110 for forcing the replacement vehicle door skin vehicle door hem flange repair member 70 with an open first angle of orientation towards vehicle door frame 74 to reorient the hem flange repair member 70 to its second angle of closed orientation with the vehicle door frame 74 interleaved between the vehicle door hem flange repair member 70 and the replacement vehicle door skin 72 into a closed second angle of orientation with the applied adhesive 78 sandwiched therebetween to form a repaired integral door 190. The second repair tool 110 for reorienting the flange to the closed position includes a second tool support member 118 and a second tool guide member 116 defining a second tool vehicle door hem flange reorienting tool interior 120. The second repair tool 110 includes a tapered reorienting surface 130 tapered down into an orienting gap 122 between a substantially planar orienting surface 117 that is substantially parallel to a guide member 116. The second repair tool 110 includes an attachment shaft 115 for application of an actuating force to the tool 110 to force the replacement vehicle door skin vehicle door hem flange repair member 70 with the open first angle of orientation towards the vehicle door frame 74 with the door frame 74 between the replacement vehicle door skin 72 and the hem flange repair member 70 along with an applied adhesive 78. With the application of the attachment shaft 115 actuating force the tapered reorienting surface 130 forces the hem flange repair member 70 vehicle door frame 74 open angle of orientation closed along with adhesive 78 squeezed therebetween. The actuation of tapered reorienting surface 130 forces the hem flange repair member 70 vehicle door frame 74 into the orienting gap 122 between substantially planar orienting surface 117 and planar guide member 116 to provide vehicle door frame 74 interleaved between the vehicle door hem flange repair member 70 and the replacement vehicle door skin 72 with a closed second angle of orientation with the applied adhesive 78 sandwiched therebetween to form a repaired integral door 190. The invention includes the making of the vehicle body 190 hem flange skin repair with the replacement vehicle skin 72 by reusing vehicle body frame 74. The invention includes the vehicle body skin hem flange repair kit comprised of a set of the first repair tool 10 and the second repair tool 110 utilized to make the vehicle body 190 hem flange skin repair. The first tool 10 provides for efficient separation of the damaged skin from the vehicle body frame 74 and the second tool 110 provides for efficient reuse of the frame 74 with a replacement vehicle skin 72 and adhesive 78 to integrate the replacement vehicle skin to the frame by forming a new reoriented repair hem flange 70.

While I have illustrated and described a preferred embodiment of my invention, it is understood that this is capable of modification and therefore I do not wish to be limited to the precise details set forth, but desire to avail myself of such changes and alterations as fall within the purview of the following claims.

I claim:

1. A method of replacement repairing a damaged vehicle door skin with a replacement vehicle door skin, said method comprising:

providing a vehicle door to be repaired, said vehicle door having a reusable door frame and a damaged vehicle door skin attached to said door frame with a hem flange having a longitudinal length, providing repair tool kit with a first repair tool and a second repair tool, said first repair tool including a hem flange separation tool for reorienting said vehicle door hem flange from a first angle of orientation to a second angle of orientation, said hem flange separation tool including a separation tool guide member, and a separation tool shoe adjacent said separation tool guide member, said separation tool shoe comprising a separation tool leading portion with a separation tool leading edge adapted to be located beneath said flange and a separation tool reorienting surface for directing and displacing said flange to an orientation between said first angle of orientation and said second angle of orientation, moving said hem flange separation tool along said longitudinal length of said vehicle door hem flange of said vehicle door to reorient said vehicle door hem flange from said first angle of orientation to said second angle of orientation to separate said vehicle door skin from said door frame, removing the damaged vehicle door skin, providing a replacement vehicle door skin vehicle door hem flange repair member with an open first angle of orientation, positioning said vehicle door frame in said replacement vehicle door skin vehicle door hem flange repair member open first angle of orientation, providing a longitudinally extending bead of adhesive, said repair tool kit second repair tool comprising a second tool guide support with an upwardly extending second tool support member and a second tool guide member, said second tool support member and said second tool guide member defining a second tool vehicle door hem flange reorienting tool interior and a second tool trailing portion which includes a second tool substantially planar trailing reorienting surface, said substantially planar trailing reorienting surface substantially parallel to said second tool guide member, said substantially planar trailing reorienting surface and said parallel second tool guide member defining a second tool trailing reorienting gap therebetween, progressively displacing said second tool longitudinally along said open first angle of orientation replacement vehicle door skin hem flange repair member wherein said second tool reorienting surface progressively reorients said replacement vehicle door hem flange repair member from said open first angle of orientation and squeezes said adhesive between said vehicle door hem flange repair member and said vehicle door frame with said vehicle door frame interleaved between said vehicle door hem flange repair member and said replacement vehicle door skin into a closed second angle of orientation with said adhesive sandwiched between the vehicle door hem flange repair member and the vehicle door frame, said interleaved closed second angle of orientation vehicle door skin, vehicle door frame, vehicle door hem flange repair member and squeezed adhesive bead progressively exiting from said second tool through said second tool trailing reorienting gap as said second tool is progressively displaced along said longitudinal length.

2. A method of making a vehicle body hem flange skin repair with a replacement vehicle skin, said method includes providing a vehicle body member to be repaired with the vehicle body member having a reusable frame and a damaged vehicle body skin attached to said frame with a hem flange having a hem flange longitudinal length, providing a vehicle body skin hem flange repair kit comprising a first tool hem flange separator and a second tool hem flange reorientor, progressively moving said first tool hem flange separator along said longitudinal length of said vehicle hem flange to reorient said vehicle hem flange from a first angle of orientation to a second angle of orientation to separate said vehicle skin from said frame, removing the damaged vehicle body skin, providing a replacement vehicle skin repair member with an open first angle of orientation, positioning said vehicle frame in said replacement vehicle skin vehicle hem flange repair member open first angle of orientation, providing a longitudinally extending bead of adhesive, progressively displacing said second tool hem flange reorientor along said open first angle of orientation replacement vehicle skin hem flange repair member wherein said second tool progressively reorients said replacement vehicle hem flange repair member from said open first angle of orientation and squeezes said adhesive between said vehicle hem flange repair member and said vehicle frame with said vehicle frame interleaved between said vehicle hem flange repair member and said replacement vehicle skin into a closed second angle of orientation with said adhesive sandwiched between the vehicle hem flange repair member and the vehicle frame, said interleaved closed second angle of orientation vehicle skin, vehicle door frame, vehicle door hem flange repair member and squeezed adhesive bead progressively exiting from said second tool through a second tool trailing reorienting gap.

3. A vehicle body skin hem flange repair kit, said vehicle body skin hem flange repair kit comprising a first repair tool and a second repair tool, said first repair tool comprising a hem flange separation tool for reorienting a damaged vehicle body skin hem flange from a first angle of orientation to a separated second angle of orientation, said hem flange separation tool including a separation tool guide member and a separation tool leading portion with a separation tool leading edge adapted to be located beneath said hem flange and a separation tool reorienting surface for directing and displacing said hem flange to an orientation between said first angle of orientation and said second angle of orientation, and said second repair tool comprising a hem flange reorientor with a guide member defining a second tool vehicle body skin hem flange reorienting tool interior and a second tool shoe member supported by a second tool support member, said second tool shoe member extending outwardly from said second tool support member into said vehicle body skin hem flange reorienting tool interior, said second tool shoe member spaced away from said second tool guide member, said second tool shoe member having a second tool reorienting surface that has a second tool leading reorienting surface and a second tool trailing portion which includes a second tool substantially planar trailing reorienting surface, said substantially planar trailing reorienting surface substantially parallel to said second tool guide member, said substantially planar trailing reorienting surface and said parallel second tool guide member defining a second tool trailing reorienting gap therebetween, said second tool shoe member leading reorienting surface progressively tapered down to said second tool trailing reorienting surface.

* * * * *